US005524295A

United States Patent [19]

Ford

[11] Patent Number: 5,524,295

[45] Date of Patent: Jun. 11, 1996

[54] TOILET SEAT ADAPTER FOR CHILDREN

[76] Inventor: Karl L. Ford, 215 Goodner Ave., LaSalle, Colo. 80645

[21] Appl. No.: 352,525

[22] Filed: Dec. 9, 1994

[51] Int. Cl.[6] ..... A47K 13/06

[52] U.S. Cl. ..... 4/239; 4/902; 4/254

[58] Field of Search ..... 4/239, 235, 902, 4/254, 239

[56] References Cited

U.S. PATENT DOCUMENTS

| | | | |
|---|---|---|---|
| 806,176 | 12/1905 | Oakley | 4/239 |
| 1,089,040 | 3/1914 | Block | 4/239 |
| 1,170,669 | 2/1916 | Ridgely | 4/239 |
| 1,867,674 | 7/1932 | McCandless . | |
| 2,053,566 | 9/1936 | Kreil | 4/239 |
| 2,127,020 | 8/1938 | Carlson | 155/165 |
| 2,516,557 | 7/1950 | Frazee et al. | 4/239 |
| 2,518,272 | 8/1950 | Beckwith | 4/239 |
| 2,940,086 | 6/1960 | Wondrack | 4/239 |
| 4,254,514 | 3/1981 | Sakamoto | 4/239 |
| 4,503,571 | 3/1985 | Sidney | 4/239 |

*Primary Examiner*—Henry J. Recla
*Assistant Examiner*—Charles R. Eloshway
*Attorney, Agent, or Firm*—William E. Hein

[57] ABSTRACT

A child's toilet seat adapter that permits use of a standard adult toilet by children comprises a unitized structure including a flat seat member having a central opening therein and a handgrip adjacent each side edge thereof, together with a footrest extending downwardly and forwardly from a front edge of the seat member, the seat member having a pair of attachment flanges, each of which is formed to extend downwardly and inwardly from a side edge of the seat member, the attachment flanges adapted to slide over and retain opposite side edges of the seat of the standard adult toilet.

4 Claims, 1 Drawing Sheet

TOILET SEAT ADAPTER FOR CHILDREN

BACKGROUND AND SUMMARY OF THE INVENTION

This invention relates generally to toilet seats for children and more particularly to a toilet seat adapter that is portable and that can be easily attached to any standard toilet seat to enable small children to use a standard size toilet.

Several children's toilet seats are known in the prior art. Exemplary of such seats are those described in U.S. Pat. Nos. 1,867,674, 2,127,020, and 2,940,086. U.S. Pat. No. 1,867,674 to Candless describes a child's toilet seat involving moving parts that hook at points along the inner periphery of the opening in an ordinary toilet seat. U.S. Pat. No. 2,127,020 to Carlson describes a cumbersome infant trainer that includes hooks for engaging the inner periphery of the opening in a standard toilet seat and a member that engages the inner surface of the toilet bowl itself. U.S. Pat. No. 2,940,086 to Wondrack describes yet another bulky infant's toilet seat of the type that includes a rubber or flexible plastic sheath that is attached over the outer surface of the toilet bowl to thereby secure the infant's seat in the desired position atop the ordinary toilet.

It is therefore the principal object of the present invention to provide a simplified, inexpensive toilet seat adapter for children that is easily transported, that has no moving parts, and that may be quickly and easily attached to and removed from any standard toilet seat.

This and other incidental objects are accomplished in accordance with the illustrated preferred embodiment of the present invention by providing a unitized structure having a flat seat member having a central opening therein and a handgrip adjacent each side edge thereof together with a footrest extending downwardly and forwardly from a front edge of the seat member, the seat member having a pair of attachment flanges, each of which is formed to extend downwardly and inwardly from a side edge of the seat member, the attachment flanges adapted to slide over and retain opposite side edges of the seat of a standard adult toilet.

DETAILED DESCRIPTION OF THE PREFERRED EMBODIMENT

Figure 1:
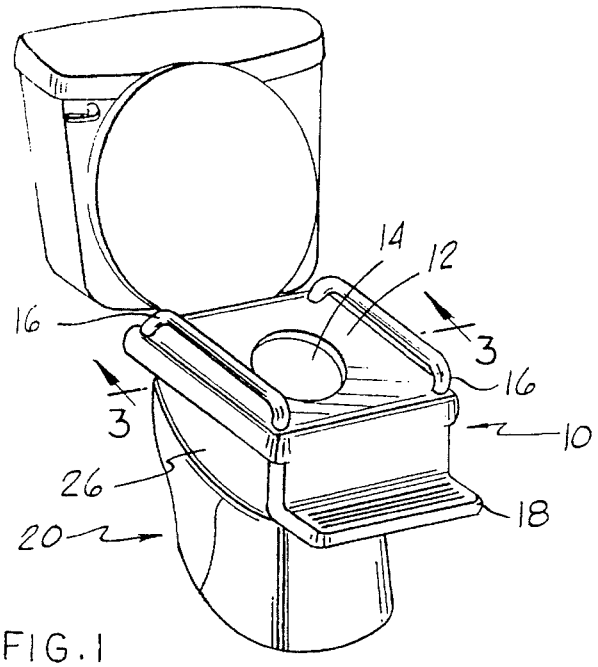
FIG. 1 is an overall pictorial diagram illustrating the child's toilet seat adapter of the present invention as it is positioned on a standard adult toilet.

Referring now to FIG. 1, there is shown a child's toilet seat adapter 10, constructed in accordance with the present invention, as it is positioned for use on a standard adult toilet 20. Toilet seat adapter 10 is preferably fabricated as a unitized structure that may comprise a plastic molded material, for example. Toilet seat adapter 10 includes a flat seat member 12 having a central opening 14 therein. Handgrips

16 are provided adjacent each side edge of seat member 12. A footrest member 18 extends downwardly and forwardly from a front edge of seat member 12. As illustrated in the detailed cross-sectional diagram of FIG. 3, seat member 12 is formed to include a pair of attachment flanges 22, each of which is formed to extend downwardly and inwardly from the side edges of seat member 12.

Figure 3:
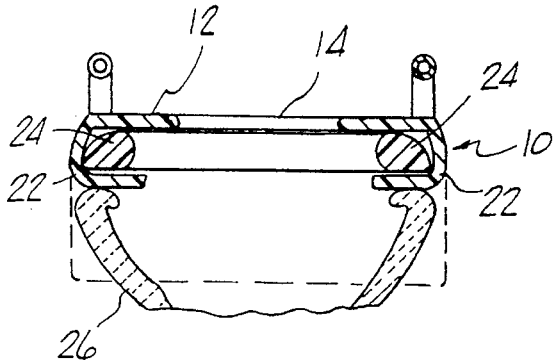
FIG. 3 is a cross-sectional diagram taken along the line 3—3 of FIG. 1 illustrating the way in which the child's toilet seat adapter attaches to the standard toilet.
Figure 2:
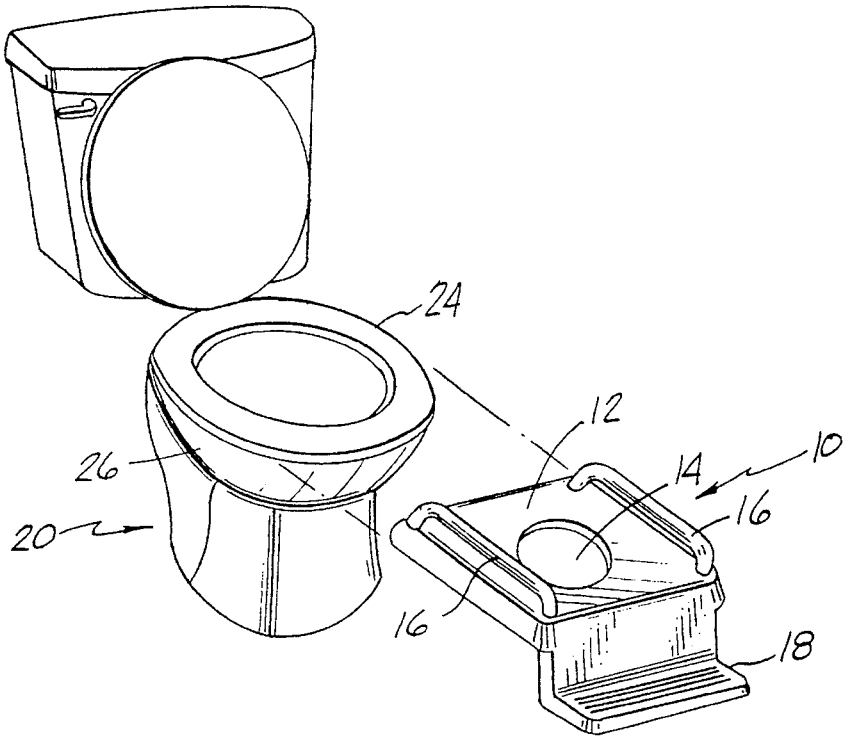
FIG. 2 is a pictorial diagram illustrating the way in which the child's toilet seat adapter of FIG. 1 is positioned in preparation for attachment to a standard toilet.

In preparation for use of the child's seat adapter 10, it is simply slid over a toilet seat 24 of standard toilet 20, as illustrated in FIG. 2, to the installed position illustrated in FIG. 1. When installed, the attachment flanges 22 of seat adapter 10 rest on the upper peripheral surface of a porcelain bowl 26 of standard toilet 20, while the side edges of toilet seat 24 are retained within the attachment flanges 22, as illustrated in FIG. 3. The child's seat adapter 10 may be quickly and easily removed from standard toilet 20 by simply sliding it off toilet seat 24.

I claim:

1. A child's toilet seat adapter that permits use of a standard adult toilet by children, the toilet seat adapter comprising:

a rectangularly-shaped, generally flat seat member having front, rear, left side, and right side peripheral edges and having a central opening therein, each of said left and right side peripheral edges of said seat member including an associated attachment flange that extends along the entirety of said peripheral edge and that is formed to extend downwardly and inwardly therefrom, each of said attachment flanges being adapted to slide over and wrap around opposite side edges of a hinged seat of the standard adult toilet to thereby retain said toilet seat adapter in place on top of said hinged seat; and a footrest member extending downwardly and forwardly from said front peripheral edge of said seat member.

2. A child's toilet seat adapter as in claim 1, further comprising a pair of handgrips positioned adjacent said left and right side peripheral edges of said seat member.

3. A child's toilet seat adapter as in claim 1, wherein said seat member and said footrest member comprise a unitized plastic molded structure.

4. A method for permitting use of a standard adult toilet by children, the method comprising:

providing a toilet seat adapter having a rectangularly-shaped, generally flat seat member having front, rear, left side, and right side peripheral edges and having a central opening therein, each of said left and right side peripheral edges of said seat member including an associated attachment flange that extends along the entirety of said peripheral edge and that is formed to extend downwardly and inwardly therefrom, each of said attachment flanges being adapted to slide over and wrap around opposite side edges of a hinged seat of the standard adult toilet to thereby retain said toilet seat adapter in place on top of said hinged seat, said toilet seat adapter having a footrest member extending downwardly and forwardly from said front peripheral edge of said seat member; and sliding said toilet seat adapter over the seat of the standard adult toilet in preparation for use of the standard adult toilet by a child.

* * * * *